US010466625B2

(12) United States Patent
Porat et al.

(10) Patent No.: US 10,466,625 B2
(45) Date of Patent: Nov. 5, 2019

(54) CONTROLLING ENGAGEMENT FORCE

(71) Applicant: HP INDIGO B.V., Amstelveen (NL)

(72) Inventors: Amit Porat, Rehovot (IL); Maty Verner, Ness Ziona (IL); Alon Froom, Ness Ziona (IL); Meir Grinstein, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/072,983

(22) PCT Filed: Apr. 28, 2016

(86) PCT No.: PCT/EP2016/059571

§ 371 (c)(1),
(2) Date: Jul. 26, 2018

(87) PCT Pub. No.: WO2017/186300

PCT Pub. Date: Nov. 2, 2017

(65) Prior Publication Data

US 2019/0033754 A1 Jan. 31, 2019

(51) Int. Cl.

| | |
|---|---|
| ***G03G 15/08*** | (2006.01) |
| ***G03G 15/10*** | (2006.01) |
| ***G03G 21/16*** | (2006.01) |

(52) U.S. Cl.

CPC ..... *G03G 15/104* (2013.01); *G03G 15/0806* (2013.01); *G03G 15/0813* (2013.01); *G03G 21/1647* (2013.01); *G03G 21/1671* (2013.01); *G03G 21/1676* (2013.01); *G03G 15/10* (2013.01); *G03G 2215/0658* (2013.01); *G03G 2221/1654* (2013.01)

(58) Field of Classification Search

CPC ..... G03G 15/08; G03G 15/10; G03G 15/104; G03G 21/16; G03G 21/1647; G03G 21/1871

USPC .... 399/38, 53, 107, 110, 111, 116, 117, 119, 399/120

See application file for complete search history.

(56) References Cited

U.S. PATENT DOCUMENTS

| | | | |
|---|---|---|---|
| 4,945,381 | A | 7/1990 | Yamagata et al. |
| 5,369,474 | A | 11/1994 | Yamada et al. |
| 6,016,419 | A | 1/2000 | Hirai et al. |
| 7,003,248 | B2 | 2/2006 | Kurotori et al. |
| 8,275,297 | B2 | 9/2012 | Izawa et al. |

(Continued)

FOREIGN PATENT DOCUMENTS

| | | |
|---|---|---|
| EP | 2075640 | 7/2009 |
| JP | 0631462 A | 2/1994 |

*Primary Examiner* — Hoan H Tran

(74) *Attorney, Agent, or Firm* — HP Inc. Patent Department

(57) ABSTRACT

Measures for controlling an engagement force between a photo imaging plate (110) and a developer roller (200) in a printing device (100) are described. A motor (310) is operated to generate rotational motion. The rotational motion is translated into linear motion. The linear motion causes an adjustment to the engagement force between the developer roller and the photo imaging plate. A characteristic of the motor is monitored. The motor is controlled on the basis of the monitored characteristic in order to maintain a desired engagement force between the developer roller and the photo imaging plate.

15 Claims, 6 Drawing Sheets

(56) References Cited

U.S. PATENT DOCUMENTS

| | | | | |
|---|---|---|---|---|
| 8,369,743 | B2 * | 2/2013 | Maeshima | G03G 21/1825 399/111 |
| 8,428,490 | B2 * | 4/2013 | Kawai | G03G 21/1623 399/113 |
| 8,695,529 | B2 | 4/2014 | Fukui et al. | |
| 8,745,870 | B2 | 6/2014 | Kawamura et al. | |
| 9,128,431 | B2 | 9/2015 | Wagatsuma et al. | |
| 9,429,877 | B2 * | 8/2016 | Sato | G03G 21/1825 |
| 2009/0232545 | A1 | 9/2009 | Tonges et al. | |

* cited by examiner

CONTROLLING ENGAGEMENT FORCE

BACKGROUND

Liquid electrophotographic printing, also referred to as liquid electrostatic printing, uses liquid toner to form images on a print medium. A liquid electrophotographic printer may use digitally controlled lasers to create a latent image in the charged surface of an imaging element such as a photo imaging plate (PIP). In this process, a uniform static electric charge is applied to the PIP and the lasers dissipate charge in certain areas creating the latent image in the form of an invisible electrostatic charge pattern conforming to the image to be printed. An electrically charged printing substance, in the form of liquid toner, is then applied and attracted to the partially-charged surface of the PIP, recreating the desired image.

BRIEF DESCRIPTION OF THE DRAWINGS

Various features will be apparent from the detailed description which follows, taken in conjunction with the accompanying drawings, which together illustrate, by way of example only, certain examples, and wherein.

DETAILED DESCRIPTION

Figure 1:
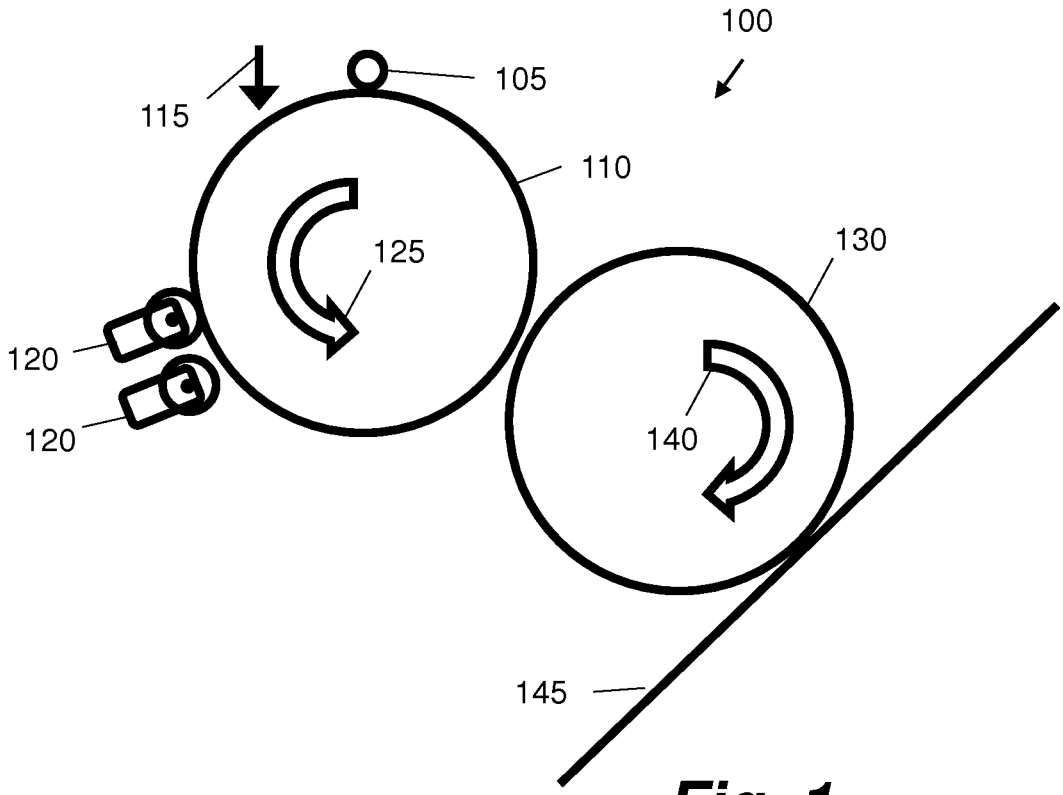
FIG. 1 is a schematic diagram showing a liquid electrophotographic printer in accordance with an example.

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

In certain liquid electrophotographic printers, a transfer element is used to transfer developed liquid toner to a print medium. For example, a developed image, comprising liquid toner aligned according to a latent image, may be transferred from a PIP to a transfer blanket of a transfer cylinder and from the transfer blanket to a desired substrate, which is placed into contact with the transfer blanket. At least two different methodologies may be used to print multi-color images on a liquid electrophotographic printer. Both methodologies involve the generation of multiple separations, where each separation is a single-color partial image. When these separations are superimposed it can result in the desired full color image being formed. In a first methodology, a color separation layer is generated on the PIP, transferred to the transfer cylinder and is finally transferred to a substrate. Subsequent color separation layers are similarly formed and are successively transferred to the substrate on top of the previous layer(s). This is sometimes known as a "multi-shot color" imaging sequence. In a second methodology, a "one shot color" process is used. In these systems, the PIP transfers a succession of separations to the transfer blanket on the transfer cylinder, building up each separation layer on the blanket. Once some number of separations are formed on the transfer blanket, they are all transferred to the substrate together. Both methodologies result in a full colour image being formed.

In some electrophotographic printers, a binary ink developer (BID) comprises the liquid toner which is transferred to the PIP. The liquid toner comprises ink particles and a carrier liquid. More than one BID can be used, each BID comprising different colour ink. The ink or pigment particles are charged and may be arranged upon the PIP based on a charge pattern of a latent image. Once liquid toner is applied to the latent image on the PIP, an inked image is formed on the PIP. The inked image comprises ink particles that are aligned according to the latent image. An example BID includes a developer roller which contacts, or engages, the PIP to allow the ink to be electrostatically and mechanically transferred from the BID to the PIP.

Maintaining the developer roller against the PIP roller with a fixed and uniform force is important to obtain a good print quality because ink is transferred in the process.

An example liquid electrophotographic printer comprises an imaging element such as a PIP. The PIP may be implemented as a drum or a belt. A latent image is generated on the PIP and at least one binary ink developer (BID) deposits a layer of liquid toner onto the PIP. Once liquid toner is applied to the latent image on the PIP, an inked image is formed on the PIP. The inked image comprises ink particles that are aligned according to the latent image. In one case, the ink particles may be 1-2 microns in diameter. A transfer element, sometimes referred to as an intermediate transfer member, receives the inked image from the PIP and transfers the inked image to a print substrate. In an example one shot color process, the inked image comprises one of a plurality of separation layers and the transfer element receives multiple separation layers of inked images from the PIP. The layers are then built up upon the transfer element prior to transferring all of the layers to the print substrate. In some examples, each of the multiple inked images are a different color.

An example BID comprises a developer roller onto which the liquid toner is applied. The developer roller is brought into contact with the surface of the PIP and the liquid toner is transferred to the PIP through a combination of mechanical and electrostatic forces. In an example, the developer roller rotates about an axis and the PIP rotates about a separate axis. These axes may be substantially parallel. The developer roller and PIP can be engaged and disengaged by changing the inter-axial distance between the developer roller and the PIP. In the engaged position, liquid toner can be transferred from the developer roller to the PIP. For example, starting from a disengaged position, the inter-axial distance may be reduced until the developer roller and PIP engage. Once engaged, the inter-axial distance may be reduced further. This increases the contact/engagement force between the developer roller and the PIP. This contact region is sometimes known as the nip.

The inter-axial distance between the developer roller and PIP can therefore be varied to apply pressure over the contact area. In some examples, the surface of the developer roller and/or PIP may be deformed as the respective surfaces are engaged. For example, if the engagement force is large, the contact area may be increased when compared with a relatively small engagement force.

Good print quality often relies on a fixed and uniform engagement force being maintained between the developer roller and PIP during engagement. Deviation of the force along the NIP impacts the delicate balance between the electrical and mechanical forces applied to the ink which thus impacts the arrangement of the ink particles on the PIP. The consistent arrangement of the ink on the PIP on the micro scale is important for gaining high print quality.

In some printers, a resilient biasing means, such springs or a pneumatic piston, forces, and holds, the developer roller and the PIP together in the engaged configuration. Such a system involving springs can mean that the force between the developer roller and PIP is not consistent, which leads to reduced print quality. Use of springs to directly control the engagement force may lead to ink layer non-uniformity, and banding may be visible in the final printed image. Therefore accurate control of the engagement force will lead to higher print quality.

Certain examples comprise printing devices which provide a more consistent and accurate engagement force. Example printing devices provide a fixed and uniform engagement force between the developer roller and PIP to improve print quality. Example printing devices allow more accurate control over the engagement force.

In one example, a printing device comprises a photo imaging plate, a developer roller, a motor, a controller and a motion transforming mechanism. The motion transforming mechanism transforms rotational motion generated by the motor into linear motion. In one example, the motion transforming mechanism comprises a cam. The cam is caused to rotate by the motor and the cam transforms the rotational motion into linear motion. In other examples the motion transforming mechanism comprises a screw, or a linear motor is operated to generate the linear motion directly.

The linear motion of the motion transforming mechanism adjusts the engagement force between the developer roller and the photo imaging plate. For example, the linear motion causes an adjustment to the inter-axial distance between the photo imaging plate and the developer roller. Moving the developer roller and the photo imaging plate relative to each other adjusts the engagement force between them.

The controller monitors characteristics of the motor, and on the basis of the monitored characteristics, controls the motor in order to maintain a desired engagement force between the developer roller and the photo imaging plate. For example, the motor is controlled to adjust the inter-axial distance between the photo imaging plate and the developer roller to maintain the desired engagement force. The example printing device therefore allows precise control over the engagement force between the developer roller and PIP. Reference to "characteristics" or "a characteristic", or a singular element, such as a motor, can be singular or plural. For example, a characteristic or characteristics can mean one or more characteristics. A motor or motors can be one or more motors.

Such an example printing device allows the control of the engagement nip force, where the force is applied by a mechanical means (such as a spring), by controlling the force applied to the nip by the mechanical means, using an electromechanically controlled device (such as a motor and a cam). For example, the force applied by the mechanical means may be reduced.

Reference to "maintaining" a value at a desired value relates to the process of altering variables so that the measured value matches the desired value. This may be an iterative process whereby the difference between the measured value and the desired value is minimized by altering the variables. The measured value may be said to match the desired value if it is within a certain range of the desired value. For example, within 10%, or 20% of the desired value.

In an example, the controller controls the motor to begin rotating. Initially, the developer roller and the PIP are not engaged. This rotational motion output by the motor is transformed into linear motion by the motion transforming mechanism. The linear motion causes the developer roller to engage the PIP. For example the developer roller may move, as a result of the linear motion, towards the PIP. The engagement force would increase if the motor continues to rotate in the same direction and the linear motion occurs in the same direction. In some examples, a desired engagement force results in a desired print quality. Therefore, to facilitate the engagement force more closely matching the desired engagement force, the controller monitors a characteristic of the motor and on the basis of the characteristic, controls the motor such that the engagement force is maintained at the desired engagement force. In other examples the controller monitors one or more characteristics and controls the motor on the basis of the one or more characteristics. The controller therefore controls the motor in order to maintain this desired engagement force. For example, as the inter-axial distance between the developer roller and PIP decreases, the engagement force increases until it matches the desired engagement force. The controller may then control the motor to stop it rotating. If the motor no longer rotates, the linear motion no longer reduces the inter-axial distance between the developer roller and the PIP. In this way, the desired engagement force is maintained. Such adjustments to the engagement force can also occur during a print run.

In another example, the engagement force deviates from the desired engagement force during printing. For example due to mechanical runout. In this case, the controller may control the motor to adjust the engagement force. For example, the controller may instruct the motor to adjust its rotational position. The motor may then rotate by a defined amount, or in a particular direction. The linear motion then alters the inter-axial distance between the developer roller and PIP so that the engagement force matches, or closely matches the desired engagement force. This allows precise control of the engagement force.

In one example, one of the monitored characteristics of the motor comprises a torque. The torque is the torque output/generated by the motor. The torque may be measured. Therefore, as the motor rotates, a torque is generated. The generated torque may vary as the engagement force varies. As the engagement force approaches the desired engagement force, the torque monitored by the controller may approach a desired, or set-point torque. For example, the desired torque may be reached when the engagement force matches the desired engagement force. A desired torque may be calibrated by measuring the engagement force or the mechanical means force. The controller controls the motor to maintain the torque at the desired torque. This results in the engagement force being maintained at the desired engagement force. Therefore, if the monitored torque deviates from the desired torque, for example due to developer roller runout, the motor rotates until the torque returns to the desired torque. This means that in some examples during printing, the motor is free to move according to the external torque applied to it. In this way a desired engagement force can be maintained.

In one example, when the developer roller and the PIP engage, the motor experiences a torque reduction. As the motor approaches the set-point target torque, or desired torque, the motor stops rotating as instructed by the controller. This process ensures a uniform engage force along the developer roller, ensures consistency over time and reduces the force variation between presses. This system therefore applies a closed loop on the torque e.g. a fractional increase in the torque value will result in rotation of the motor until the torque returns back to the desired set-point torque.

FIG. 1 is a schematic diagram showing a liquid electrophotographic printer 100 in accordance with an example. Liquid electrophotography, sometimes also known as Digital Offset Color printing, is the process of printing in which liquid toner is applied onto a surface having a pattern of electrostatic charge (i.e. a latent image) to form a pattern of liquid toner corresponding with the electrostatic charge pattern (i.e. an inked image). This pattern of liquid toner is then transferred to at least one intermediate surface, and then to a print medium. During the operation of a digital liquid electrophotographic system, ink images are formed on the surface of a PIP. These ink images are transferred to a heatable blanket cylinder and then to a print medium.

According to the example of FIG. 1, a latent image is formed on an imaging element 110 by rotating a clean, bare segment of the photo imaging plate 110 under a photo charging unit 105. The PIP 110 in this example is cylindrical in shape, e.g. is constructed in the form of a drum, and rotates in a direction of arrow 125. The photo charging unit 105 may include a charging device, such as corona wire, a charge roller, scorotron, or any other charging device. A uniform static charge may be deposited on the PIP 110 by the photo charging unit 105. As the PIP 110 continues to rotate, it passes an imaging unit 115 where laser beams may dissipate localised charge in selected portions of the PIP 110 to leave an invisible electrostatic charge pattern that corresponds to the image to be printed, i.e. a latent image. In some implementations, the photo charging unit applies a negative charge to the surface of the PIP 110. In other implementations, the charge may be a positive charge. The imaging unit 115 may then locally discharge portions of the PIP 110, resulting in local neutralised regions on the PIP 110.

In example printing devices ink is transferred onto the PIP 110 by at least one image development unit 120. An image development unit may also be known as a Binary Ink Developer (BID) or developer unit. There may be one BID 120 for each ink color. In the example of FIG. 1, only two BIDs are shown. During printing, a developer roller within the appropriate BID 120 engages the PIP 110. The engaged BID 120 presents a uniform film of ink to the PIP 110. The ink contains electrically-charged pigment particles which are attracted to the opposing charges on the image areas of the PIP 110. The ink is repelled from the uncharged, non-image areas. The PIP 110 now has a single color ink image on its surface, i.e. an inked image or separation. In other implementations, such as those for black and white (monochromatic) printing, ink developer units may alternatively be provided.

The ink may be a liquid toner, comprising ink particles and a carrier liquid. The carrier liquid may be an imaging oil. An example liquid toner ink is HP ElectroInk™. In this case, pigment particles are incorporated into a resin that is suspended in a carrier liquid, such as Isopar™. The ink particles may be electrically charged such that they move when subjected to an electric field. Typically, the ink particles are negatively charged and are therefore repelled from the negatively charged portions of PIP 110, and are attracted to the discharged portions of the PIP 110. The pigment is incorporated into the resin and the compounded particles are suspended in the carrier liquid. The dimensions of the pigment particles are such that the printed image does not mask the underlying texture of the print substrate, so that the finish of the print is consistent with the finish of the print substrate, rather than masking the print substrate. This enables liquid electrophotographic printing to produce finishes closer in appearance to conventional offset lithography, in which ink is absorbed into the print substrate.

Returning to the printing process, the PIP 110 continues to rotate and transfers the ink image to a transfer element 130, which may be heatable. The transfer element 130 may also be known as a blanket cylinder or an intermediate transfer member (ITM) and it rotates in a direction of arrow 140. The transfer of an inked image from the PIP 110 to the transfer element 130 may be deemed the "first transfer". Following the transfer of the inked image onto the rotating and heated transfer element 130, the ink is heated by the transfer element 130. In certain implementations, the ink may also be heated from an external heat source which may include an air supply. This heating causes the ink particles to partially melt and blend together. As previously discussed, in liquid electrophotography printers employing a one shot color process, the PIP 110 rotates several times, transferring a succession of separations and building them up on the transfer element 130 before they are transferred to the print substrate 145. This transfer from the transfer element 130 to the print substrate 145 may be deemed the "second transfer". Each separation may be a separate color inked image that can be layered on the transfer element 130. For example, there may be four layers, corresponding to the standard CMYK colors (cyan, magenta, yellow and black), that make up the final image which is transferred to the print substrate 145. In such examples there would be four BIDs 120. The print substrate 145 may be fed on a per sheet basis, or from a roll sometimes referred to as a web substrate. As the print substrate 145 contacts the transfer element 130, the final image is transferred to the print substrate 145.

Figure 2:
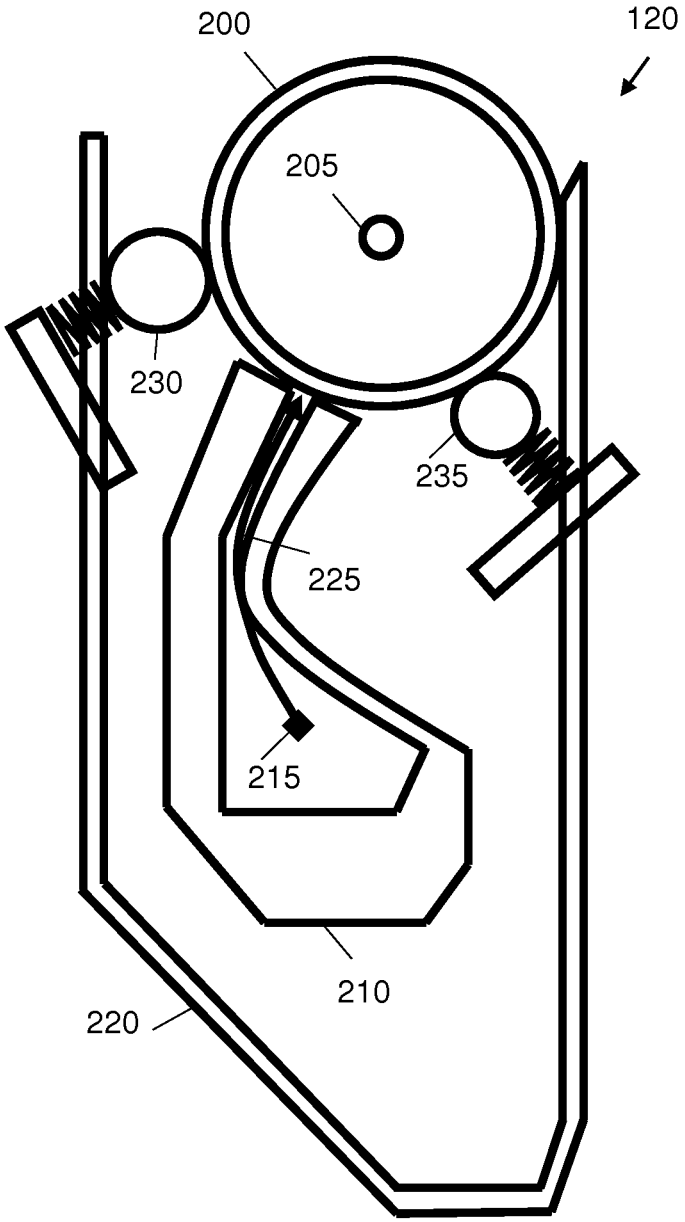
FIG. 2 is a schematic diagram showing a binary ink developer in accordance with an example.

FIG. 2 is a schematic diagram showing a binary ink developer 120 (BID) in accordance with an example. The BID 120 may also be known as a developer unit 120 and comprises a BID base 220. The BID may be the same as or similar to the BIDs depicted in FIG. 1. The BID 120 comprises a developer roller 200 comprising a surface for transferring ink applied thereto to a PIP 110. In this example, the developer roller 120 is a cylindrical roller which rotates about an axis 205 which extends into the page. In other examples, the developer roller 200 may be of a different form, such as a belt or plate.

In some examples, the surface of the developer roller 200 is deformable to an extent necessary to provide close contact with the PIP 110.

In this example, the BID 120 comprises an ink inlet 215 and electrodes 210 as part of the BID 120. Ink for application to the surface of the developer roller 200 is positively or negatively charged and enters the BID 120 through the ink inlet 215, for example from an ink reservoir. The electrodes 210 are held at an electrical potential, the same polarity as the charged ink. In this example, the surface of the developer roller is electrically conductive and in use is held at an electrical potential which is less than the potential of the electrodes. For example if the ink is negatively charged, the electrodes 210 may be held at −1500V and the developer roller may be held at −400V. In an example where the ink is positively charged, the electrodes 210 may be held at 1500V and the developer roller may be held at 400V.

The potential difference between the developer roller 200 and the electrodes 210 causes the ink to be electrostatically transferred from the ink inlet 215 to the surface of the developer roller 200. Arrow 225 illustrates the direction of ink flow. It is to be appreciated that an alternative ink supply apparatus could be used in other examples. For example, in other examples the electrodes 210 may not be held at a potential, and the ink may be transferred mechanically to the developer roller. In some examples, the speed of rotation of the developer roller 200 may be chosen in accordance with a rate of supply of the ink to achieve a uniform layer of ink on its surface. In addition, the BID 120 may comprise a pressure roller 230, such as a squeegee roller in contact with the developer roller 200 for applying pressure to the surface of the developer roller 200. This application of pressure by the pressure roller 230 skims the ink that has been applied to the developer roller 200 so that the ink is more solid than liquid. The BID 120 may also comprise a cleaner roller 235 which cleans unused ink from the developer roller 200.

Figure 3A:
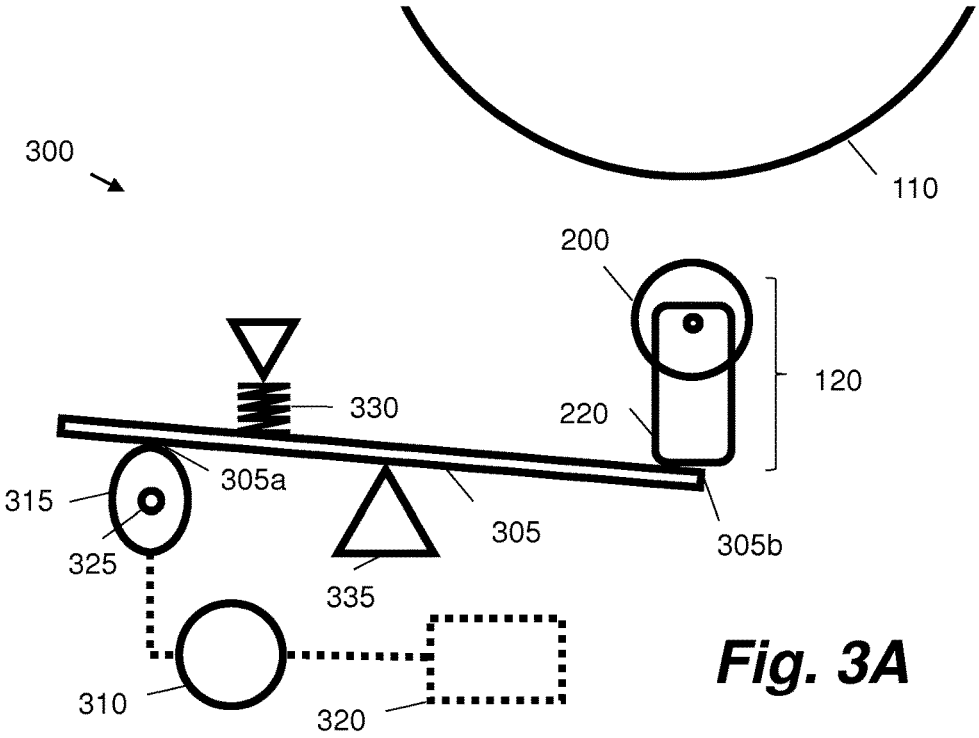
FIG. 3A is a schematic diagram showing binary ink developer engagement apparatus in a disengaged configuration in accordance with an example.
Figure 3B:
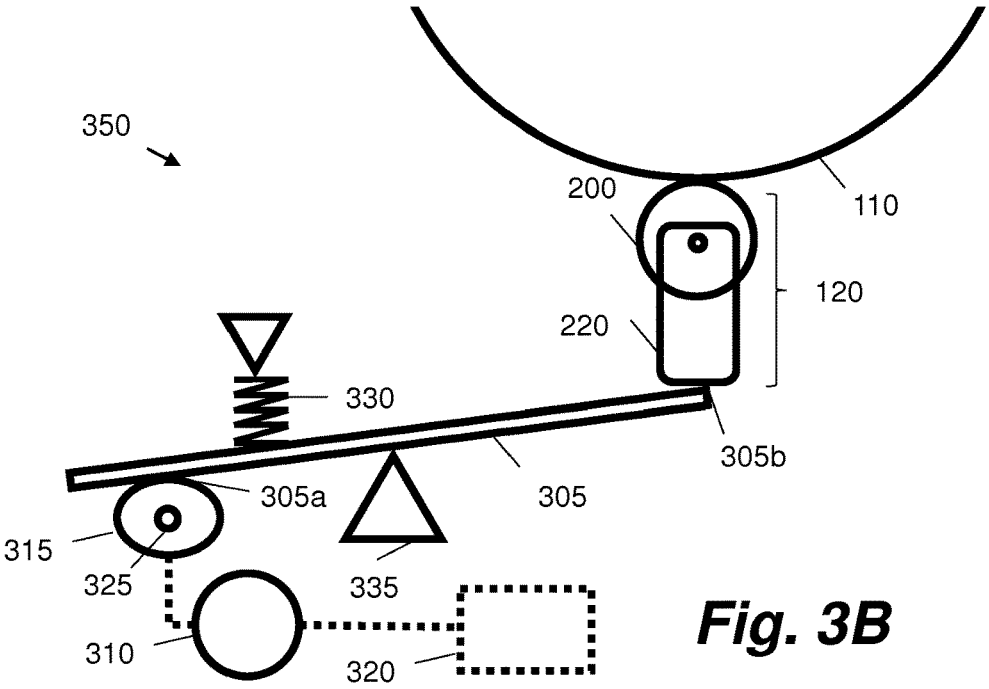
FIG. 3B is a schematic diagram showing binary ink developer engagement apparatus in an engaged configuration in accordance with an example.

FIG. 3A is a schematic diagram showing binary ink developer engagement apparatus in a disengaged configuration 300 in accordance with an example. FIG. 3B shows the same binary ink developer engagement apparatus in an engaged configuration 350. The apparatus enables control over the engagement force between a developer roller 200 and a PIP 110, for example to achieve a desired fixed and uniform engagement force.

The apparatus comprises a BID unit 120 comprising a developer roller 200 which is moveable relative to the PIP 110. A motor 310, controlled by controller 320, can be operated to generate rotational motion. The rotational motion generated by the motor is transformed into linear motion by the motion transforming mechanism 315.

The motor 310 may be a stepper motor or a servo motor, however other types of motor may be used. A stepper motor or servo motor's rotational position can be accurately controlled. For example, the motor 310 can be commanded to move to a certain position and hold its position.

The controller 320 is communicatively coupled to the motor 310. The controller 320 may also be communicatively coupled to apparatus to monitor or measure characteristics of the motor.

In this example, the motion transforming mechanism is a cam 315. Many types of cam may be used, for example the cam may be egg-shaped, an ellipse, eccentric or a snail-shaped cam. A cam provides a mechanically simple and relatively inexpensive method of moving a developer unit relative to a PIP to control their engagement force.

The motor 310 may directly cause the cam 315 to rotate about an axis 325. Alternatively, the motor 310 may indirectly cause the cam 315 to rotate, for example via gears (not shown). Rotation of the cam 315 about the axis 325 causes linear motion to be generated, for example, in a direction perpendicular to the axis of rotation 325. An object in contact with the cam 315 will be moved due to the action of the linear motion.

The apparatus further comprises an arm 305, such as a lever arm which can rotate about a rotation axis. In this example, the arm 305 rotates about a fulcrum 335. A first portion 305*a* of the lever arm 305 abuts the cam 315 and a second portion 305*b* abuts the developer unit 120 which comprises the developer roller 200. Rotation of the lever arm causes the position of the developer unit and developer roller to move relative to the photo imaging plate 110 to adjust the engagement force between the developer roller 200 and the photo imaging plate 100. Use of a lever arm 305 reduces the force employed to move the developer roller 200 relative to the PIP 110. Use of a lever arm 305 also means that the size of the cam 315 can be reduced.

In this example, a biasing means, such as spring 330, biases the lever arm onto the cam, such that it contacts, or abuts the cam 315. Although the spring 330 is depicted as a compression spring above the lever arm 305, pushing the arm 305 onto the cam 315, other arrangements/springs may achieve the same goal. For example, a spring, such as a tension spring, may be placed below the arm which acts to pull the arm 305 onto the cam 315.

Linear motion of the cam 315 causes the arm 305 to rotate about the fulcrum 335. As can be seen in FIG. 3A, the cam 315 is in a first rotational position and the distance between the center of rotation of the cam 315 and the first portion 305*a* of the lever arm 305 is maximum. This configuration means that the developer roller 200 is disengaged from the PIP 110. Rotational motion of the cam 315, provided by the motor, rotates the cam 315 about its axis 325. As the cam 315 rotates, the distance between the center of rotation of the cam 315 and the first portion 305*a* of the lever arm 305 changes.

In other examples, the rotation of the motor directly causes the lever arm 305 to rotate.

FIG. 3B depicts the apparatus after the cam 315 has been rotated. In this example, the cam 315 has rotated through an angle such that the lever arm 305 rotates and the developer roller 200 and the PIP 110 begin to engage. The biasing means 330 still causes the arm 305 to abut the cam 315. The spring 330 exerts a force on the lever 305 to move the lever 305 towards the cam 315, such that the lever 305 continuously abuts the cam 315. This continuous abutment allows the action of the motor 310 and cam 315 to control the engagement force. In some engagement mechanisms, a spring directly controls the engagement force which can mean the engagement force is inconsistent over time and can lead to reduced image quality. In FIG. 3B, the distance between the center of rotation 325 of the cam 315 and the first portion 305*a* of the lever arm 305 has reduced when compared to the configuration in FIG. 3A. When the developer roller 200 and the PIP 110 just engage, the engagement force may be considered to be zero (or negligible).

The engagement force can be increased by rotating the cam further. Runout may increase the engagement force further or reduce it.

It may be desirable to maintain the engagement force at a desired engagement force to ensure good, or consistent print quality. The rotational position of the cam 315 can be adjusted by controlling the motor 310, in order to adjust the engagement force. The engagement force may be increased or decreased, for example, in order for the engagement force to match, or closely match a desired engagement force. The controller 320 may instruct the motor 310 to rotate in order to rotate the cam 315, thereby controlling the engagement force.

In one example, the motor 310 outputs characteristics which may be measured. The controller 320 may monitor, or measure these characteristics and on the basis of these monitored characteristics, control the motor in order to maintain the desired engagement force. For example, the controller 320 may monitor a torque and/or rotational position of the motor 310. As explained above, the torque may alter as the developer roller 200 and PIP 110 are brought into engagement by rotation of the cam 315. When the torque reaches a desired, or set-point torque, the controller 320 may instruct the motor 310 to stop rotating. This then maintains a desired engagement force between the developer roller 200 and PIP 110. The controller 320 therefore uses the monitored characteristics of the motor as feedback. In one example the engagement force may be increased, by reducing motor torque, or decreased, by increasing motor torque for example, in order for the engagement force to match, or closely match a desired engagement force. In some examples, the controller comprises a PID controller.

If during the print run the engagement force deviates from the desired engagement force, the monitored torque may deviate from the desired set-point torque. The controller 320, on the basis of the monitored torque, then controls the motor 310 in order to maintain the desired engagement force by maintaining the desired torque. For example, the controller 320 may determine that the monitored torque has deviated from the set-point torque. The controller 320 then controls the motor 310 to adjust its rotational position, so that the monitored torque returns to the set-point torque, which causes an adjustment to the rotational position of the cam 315. This rotational adjustment to the cam 315 results in the desired engagement force being maintained between the developer roller 200 and the PIP 110.

In an example, to control the engagement force, the force between the lever arm 305*a* and the cam 315 is varied. The force applied by the spring 330 on the lever arm may be considered constant when the developer 200 and the PIP 110 are engaged and when they are just disengaged. In one example, reducing the force between the cam 315 and the lever arm 305*a*, increases the engagement force because the spring force remains constant. In an example, $F_{cam}$ is the forced applied by the cam 315 on the lever arm 305. $T_{cam}$ is the torque on the arm applied by $F_{cam}$. $F_{spring}$ is the forced applied by the spring 330 on the arm 305. $T_{spring}$ is the torque on the arm applied by $F_{spring}$. $F_{engage}$ is the forced applied on the arm 305 by the nip between the developer roller 200 and the PIP 110. $T_{engage}$ is the torque on the arm applied by $F_{engage}$. $T_{const}$ is a constant torque applied on the arm from a known element like gravity. During disengagement: $T_{spring}=T_{cam}+T_{const}$. During engagement: $T_{spring}=T_{cam}+T_{const}+T_{engage}$. Assuming $T_{spring}$ is constant due to small nip depth, $T_{engage}=T_{cam}(\text{disengage})-T_{cam}(\text{engage})$. As the torque equation is not a function of position, by applying a desired motor torque during engage state, a desired engagement torque is obtained.

FIGS. 3A and 3B have been described with reference to one motor, however in some examples, the engagement apparatus comprises more than one motor. The example engagement apparatus may further comprise one or more motion transforming mechanisms to transform rotational motion of the one or more respective motors into linear motion. It may also comprise one or more lever arms. In this way, the engagement force along a length of the developer roller 200 may be more accurately controlled.

Figure 4:
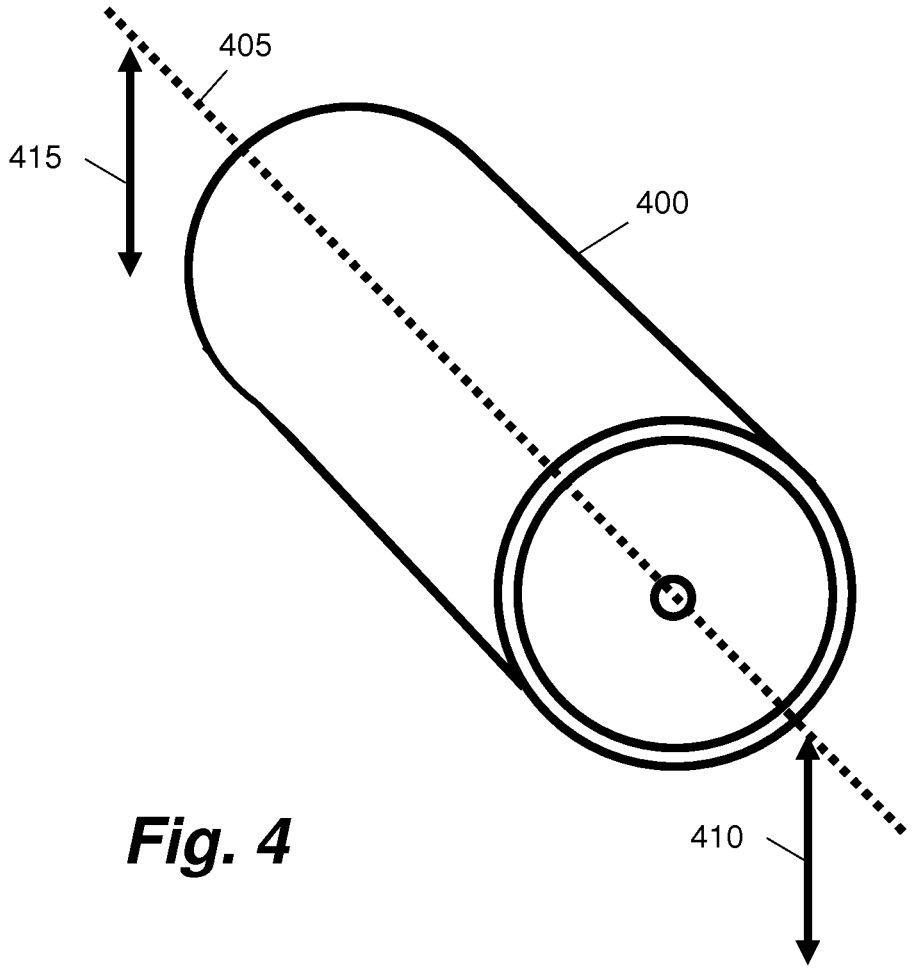
FIG. 4 is a schematic diagram showing a perspective view of a developer roller in accordance with an example.

FIG. 4 depicts a developer roller 400 which has a cylindrical form. The developer roller rotates about the axis 405. The developer roller 400 may be the same developer roller as depicted in FIGS. 1-3.

More than one engagement mechanism may be used to more accurately control the engagement force of the developer roller 400 along its length. Arrows 415 and 410 show the direction of motion in which the developer roller 400 may move as a result of the linear motion provided by the motion transforming mechanism 315, which in turn causes the lever arm 305 to move the developer unit 120 relative to the PIP 110. Apparatus such as that depicted in FIGS. 3A and 3B may be employed to each move the developer roller 400 relative to the PIP 110. For example, a first apparatus may control motion of the developer roller 400 along the direction of arrow 410, and a second apparatus may control motion along the direction of arrow 415. Therefore, linear motion can be applied to one end of the developer roller 400 and linear motion can be applied to the other end of the developer roller 400.

A printing device may further comprise an additional motor and an additional motion transforming mechanism to transform rotational motion generated by the additional motor into linear motion to adjust the engagement force between the developer roller and the photo imaging plate. The controller 320 monitors characteristics of the additional motor and on the basis of the monitored characteristics of the additional motor, controls the additional motor in order to maintain the desired engagement force between the developer roller and the photo imaging plate. In one example, the printing device comprises two motors and two motion transforming mechanisms. The first motor controls the engagement force between one end of the developer roller 400 and the PIP 110. The second motor controls the engagement force between the other end of the developer roller 400 and the PIP 110. Use of more than one motor and motion transforming mechanism can allow even more accurate control of the engagement force.

Figure 5:
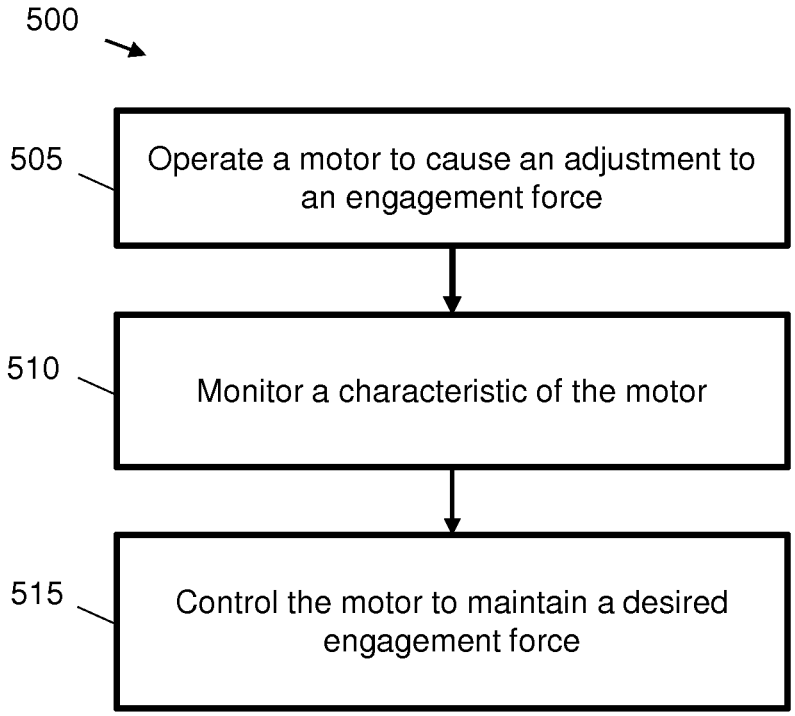
FIG. 5 is a flow diagram showing a method for controlling an engagement force between a photo imaging plate and a developer roller according to an example.

FIG. 5 is a flow diagram showing a method 500 for controlling an engagement force between a developer roller 200, 400 and a PIP 110 according to an example. The method can be performed by the engagement apparatus discussed in relation to FIGS. 1-3. At block 505, the method comprises operating a motor to generate rotational motion. The rotational motion is translated into linear motion. The linear motion causes an adjustment to the engagement force between the developer roller and the PIP. At block 510, the method comprises monitoring characteristics of the motor. At block 515, the method comprises controlling the motor on the basis of the monitored characteristics in order to maintain a desired engagement force between the developer roller and the PIP. In one example, the one monitored characteristic comprises a torque.

In another example method, block 505 may also comprise operating an additional motor. Block 510 then comprises monitoring characteristics for each of the motors. Block 515 comprises controlling each of the motors in order to maintain the desired engagement force between the developer roller and the photo imaging plate.

In some examples, controlling the motor on the basis of the monitored torque comprises adjusting a rotational position of the motor. In other examples, the rotational motion generated by the motor is translated into linear motion by a cam.

Certain system components and methods described herein may be implemented by way of non-transitory computer program code that is storable on a non-transitory storage medium. In some examples, the controller 320 may comprise a non-transitory computer readable storage medium comprising a set of computer-readable instructions stored thereon. The controller 320 may further comprise at least one processor. Alternatively, controllers 320 may implement all or parts of the methods described herein.

Figure 6:
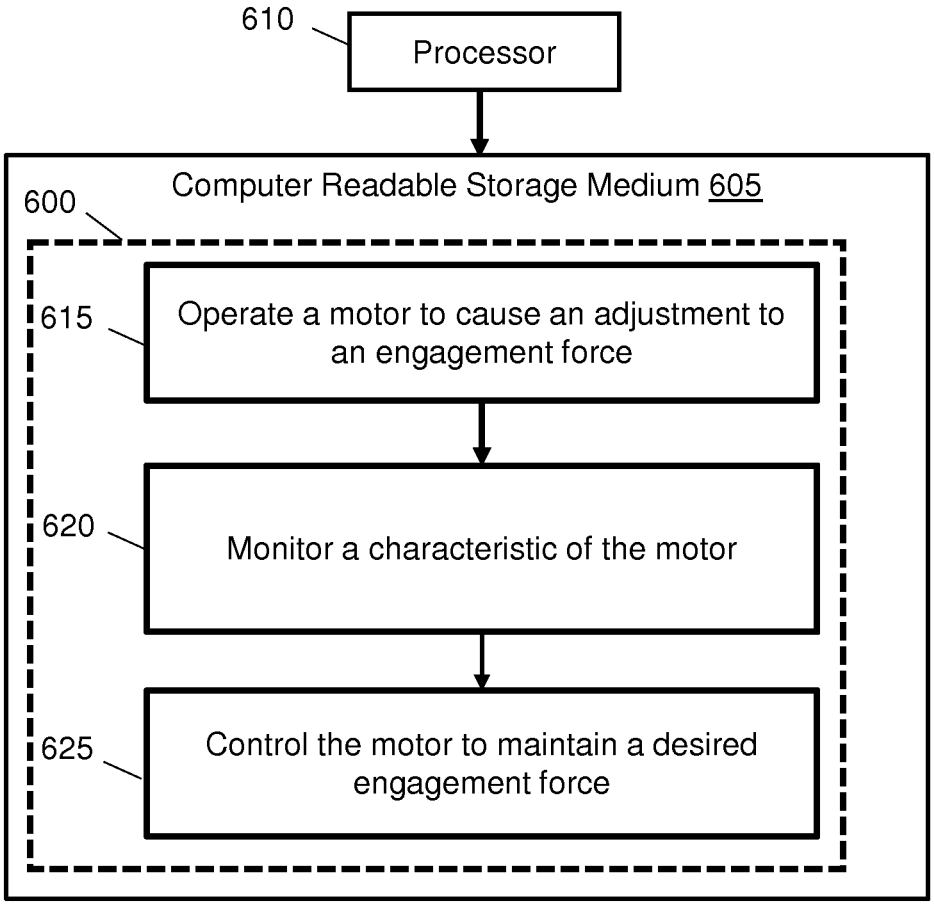
FIG. 6 is a schematic diagram showing an example set of computer readable instructions within a non-transitory computer-readable storage medium.

FIG. 6 shows an example of such a non-transitory computer-readable storage medium 605 comprising a set of computer readable instructions 600 which, when executed by at least one processor 610, cause the at least one processor 610 to perform a method according to examples described herein. The computer readable instructions 600 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 600 cause the processor 610 in a printer to, at block 615, operate a motor to generate rotational motion, wherein the rotational motion is translated into linear motion, the linear motion causing an adjustment to the engagement force between the developer roller and the PIP. At block 620, the instructions 600, cause the processor 610 to monitor characteristics of the motor. At block 625, the instructions 600, cause the processor 610 to control the motor on the basis of the monitored characteristics in order to maintain a desired engagement force between the developer roller and the PIP.

In another example, block 615 may comprise operating motors to generate rotational motion; in such an example, the rotational motion is translated into linear motion by cams and the linear motion causes an adjustment to the engagement force between the developer roller and the photo imaging plate. Block 620 then comprises monitoring characteristics for each of the motors. Block 625 comprises controlling the motors in order to maintain the desired engagement force between the developer roller and the photo imaging plate.

In some example implementations, the instructions 600 further cause the processor 610 to determine for the motors when the respective monitored characteristics deviate from respective set-points. The instructions 600 then further cause the processor 610 to control the motors such that the monitored respective one or more characteristics return to their respective set-points such that the engagement force between the developer roller and the photo imaging plate reaches a desired engagement force.

In one example, one of the characteristics is a torque and the set-point is a set-point torque.

While certain examples have been described above in relation to liquid electrophotographic printing, other examples can be applied to dry electrophotographic printing or other types of printing. Furthermore, although the examples described above relate to printing devices, the same teachings may also be applied to other systems where a force is to be maintained between two elements. For example, a device may comprise a first element, a second element, a motor, a controller and a motion transforming mechanism to transform rotational motion generated by the motor into linear motion to adjust an engagement force between the first element and the second element. The controller monitors characteristics of the motor and on the basis of the monitored characteristics, controls the motor in order to maintain a desired engagement force between the first element and the second element.

In one example there is a non-transitory computer readable storage medium comprising a set of computer-readable instructions stored thereon, which, when executed by a processor, cause the processor to, in a device: operate a motor to generate rotational motion, wherein the rotational motion is translated into linear motion by a cam, the linear motion causing an adjustment to the engagement force between a first element and a second element. In another example the rotational motion is translated into linear motion by a screw. The instructions further cause the processor to monitor a torque for the motor, determine for the motor when the monitored torque deviates from a set-point torque and control the motor such that the monitored torque returns to the set-point torque such that the engagement force between the first element and the second element reaches a desired engagement force. In some examples the engagement force is applied by a mechanical means, such as a spring, and is adjusted or controlled by the linear motion. In some examples more than one motors are operated, monitored and controlled.

In another example the motor is a linear motor which directly generates linear motion. For example, there is a non-transitory computer readable storage medium comprising a set of computer-readable instructions stored thereon, which, when executed by a processor, cause the processor to, in a device: operate a motor to generate one of linear motion or rotational motion. The linear or rotational motion causes an adjustment to the engagement force between a first element and a second element. For example, the generated rotational motion may indirectly cause the adjustment to the engagement force by being first translated into linear motion using a motion transforming mechanism, such as a cam or screw. In the other example the motor may be a linear motor and output linear motion directly. The instructions further cause the processor to monitor a characteristic for the motor and determine for the motor when the monitored characteristic deviates from a set-point characteristic. In the case of a motor outputting rotational motion, the characteristic may be a torque for example and for a motor outputting linear motion, the characteristic may be a force. The instructions further cause the processor to control the motor such that the monitored characteristics return to the set-point characteristic such that the engagement force between the first element and the second element reaches a desired engagement force. In some examples the action of the linear motion adjusts the engagement force which was applied by a mechanical means such as a spring, or other biasing means.

The preceding description has been presented to illustrate and describe examples of the principles described. This description is not intended to be exhaustive or to limit these principles to any precise form disclosed. Many modifications and variations are possible in light of the above teaching.

The invention claimed is:

1. A printing device comprising:

a photo imaging plate;

a developer roller;

a motor;

a controller; and a motion transforming mechanism to transform rotational motion generated by the motor into linear motion to adjust an engagement force between the developer roller and the photo imaging plate, wherein the controller:

monitors a characteristic of the motor; and on the basis of the monitored characteristic, controls the motor in order to maintain a desired engagement force between the developer roller and the photo imaging plate.

2. The printing device of claim 1, wherein controlling the motor on the basis of the characteristic of the motor comprises adjusting a rotational position of the motor.

3. The printing device of claim 1, wherein the monitored characteristic of the motor comprises a torque output by the motor, and the output torque is maintained at a desired torque in order to maintain the desired engagement force between the developer roller and the photo imaging plate.

4. The printing device of claim 1, wherein the motion transforming mechanism comprises a cam.

5. The printing device of claim 4, comprising:

a developer unit comprising the developer roller; and a lever arm, wherein a first portion of the lever arm abuts the cam and a second portion of the lever arm abuts the developer unit, wherein:

the linear motion of the cam causes the lever arm to rotate about an axis, and rotation of the lever arm causes the position of the developer unit and developer roller to move relative to the photo imaging plate to adjust the engagement force between the developer roller and the photo imaging plate.

6. The printing device of claim 5, comprising a biasing means to bias the lever arm onto the cam.

7. The printing device of claim 5, wherein the first portion of the lever arm continuously abuts the cam.

8. The printing device of claim 1, comprising:

an additional motor, and an additional motion transforming mechanism to transform rotational motion generated by the further motor into linear motion to adjust the engagement force between the developer roller and the photo imaging plate, wherein the controller:

monitors a characteristic of the additional motor; and on the basis of the monitored characteristic of the additional motor, controls the additional motor in order to maintain the desired engagement force between the developer roller and the photo imaging plate.

9. The printing device of claim 8, wherein the motion transforming mechanism applies linear motion to one end of the developer roller and the further motion transforming mechanism applies linear motion to the other end of the developer roller.

10. The printing device of claim 1, wherein the motor comprises:

a servo motor; or a stepper motor.

11. A method for controlling an engagement force between a photo imaging plate and a developer roller in a printing device, the method comprising:

operating a motor to generate rotational motion, wherein the rotational motion is translated into linear motion, the linear motion causing an adjustment to the engagement force between the developer roller and the photo imaging plate;

monitoring a torque of the motor; and controlling the motor on the basis of the monitored torque in order to maintain a desired engagement force between the developer roller and the photo imaging plate.

12. The method of claim 11, wherein controlling the motor on the basis of the monitored torque comprises adjusting a rotational position of the motor.

13. The method of claim 11, wherein the rotational motion generated by the motor is translated into linear motion by a cam.

14. The method of claim 11, further comprising:

operating an additional motor to generate rotational motion, wherein the rotational motion is translated into linear motion, the linear motion causing an adjustment to the engagement force between the developer roller and the photo imaging plate;

monitoring a torque of the additional motor; and controlling the additional motor on the basis of the monitored torque of the additional motor in order to maintain the desired engagement force between the developer roller and the photo imaging plate.

15. A non-transitory computer readable storage medium comprising a set of computer-readable instructions stored thereon, which, when executed by a processor, cause the processor to, in a device:

operate a motor, to generate one of linear motion or rotational motion, wherein the linear or rotational motion causes an adjustment to an engagement force between a first element and a second element;

monitor a characteristic for the motor;

determine for the motor when the monitored characteristic deviates from a set-point characteristic; and control the motor such that the monitored characteristic returns to the set-point characteristic such that the engagement force between the first element and the second element reaches a desired engagement force.

* * * * *